US006346125B1

(12) United States Patent
Mao

(10) Patent No.: US 6,346,125 B1
(45) Date of Patent: Feb. 12, 2002

(54) PROCESS FOR THE TREATMENT OF NONWOVENS WITH ANTIMICROBIAL AGENTS

(75) Inventor: Jianwen Mao, Grenzach-Wyhlen (DE)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/251,808

(22) Filed: Feb. 17, 1999

(30) Foreign Application Priority Data

Feb. 20, 1998 (EP) ..... 98810141

(51) Int. Cl.[7] ..... D06M 1/02

(52) U.S. Cl. ..... 8/115.51; 8/116.2; 428/393.4; 428/392; 428/27; 428/67; 428/298.1; 428/339

(58) Field of Search ..... 428/298, 27, 33.9, 428/393.4, 392; 8/115.51, 116.1

(56) References Cited

U.S. PATENT DOCUMENTS

| | | | | |
|---|---|---|---|---|
| 4,401,712 | A | 8/1983 | Morrison | 428/289 |
| 4,430,381 | A | 2/1984 | Harvey et al. | 428/284 |
| 4,692,374 | A | 9/1987 | Bouchette | 428/288 |

FOREIGN PATENT DOCUMENTS

| | | | |
|---|---|---|---|
| AU | 1998EP-0811085 | * 10/2000 | D01F/002/01 |
| EP | 0136900 | 4/1985 | |
| EP | 0709507 | 5/1996 | |
| GB | 2304286 | 3/1997 | |
| WO | 96/33748 | 10/1996 | |
| WO | 00/26447 | 5/2000 | |

* cited by examiner

*Primary Examiner*—Yogendra N. Gupta
(74) *Attorney, Agent, or Firm*—Kevin T. Mansfield

(57) ABSTRACT

Described is a process for the incorporation of an antimicrobial agent into a non-woven comprising treating the nonwoven with a formulation comprising (a) an antimicrobial agent selected from
- ($a_1$) halogeno-o-hydroxydiphenyl compound;
- ($a_2$) phenol derivative;
- ($a_3$) benzyl compound;
- ($a_4$) chlorohexidine and a derivative thereof;
- ($a_5$) $C_{12}$–$C_{14}$alkylbetaine and $C_8$–$C_{18}$fatty acid amidoalkylbetaine;
- ($a_6$) an amphoteric surfactant;
- ($a_7$) trihalocarbanilide;
- ($a_8$) quaternary and polyquaternary compound; and
- ($a_9$) a thiazole compound; and
- ($a_{10}$) a iodine containing agent;
- ($a_{11}$) a naphthyl derivative;

(b) a solubilizing agent; and optionally (c) at least one copolymer made from two or more monomers, with at least one monomer having good affinity to the textiles and at least another monomer having affinity to the involved antimicrobial substances.

Nonwovens finished according to the present process have long lasting antimicrobial efficacy and are advantageous with respect to inhibition of micro-organisms, reduction of the risk of contamination, reduction of odor, increase in freshness and improvement in hygienic conditions.

19 Claims, No Drawings

PROCESS FOR THE TREATMENT OF NONWOVENS WITH ANTIMICROBIAL AGENTS

The present invention relates to a process for the treatment of nonwovens with antimicrobial agents, a process for the preparation of a formulation comprising the antimicrobial agents and the nonwovens treated by this method.

"Non-woven" is a type of fabric that is not spun and woven into a cloth, but instead bonded together. According to the ISO definition it is a manufactured sheet, web, or batt of directionally or randomly orientated fibres, bonded by friction, and/or adhesion.

Nonwoven textiles are widely used in disposable as well as durable goods, such as baby diaper, feminine hygiene, adult incontinence, wipers, bed linings, automotive industries, medical face masks, air and water filtration, home furnishing and geotextiles. Such materials can be fabricated by different techniques, such as spunbonding, melt blown, carded thermal bonding and carded chemical bonding, dry and/or wet laid and needlefelts. Because of the nature of such applications the market is increasingly demanding products with specific properties such as antimicrobial efficacy. Efforts have been made in incorporating antimicrobial active agents in binders which sometimes are used to make nonwovens in processes like carded chemical bonding, dry and wet laid.

Amongst various nonwoven products, materials made by spunbonding and melt blown techniques have some unique properties and are becoming more and more important because of advantages in manufacturing as well as in product properties. Spunbond nonwovens can be made directly from thermoplastic polymers such as polypropylene, polyethylene, polyester and nylon. This process offers lower manufacturing cost, improved processability and performance in the final product such as coverstock for disposable baby diapers, feminine hygiene and adult incontinence. Spunbond nonwovens can also be used as durable products such as geotextiles and roof membranes. Characterised by a large surface area and small pore size, melt blown nonwovens differ from traditional spunbonds in their lower fibre denier and fineness. But similarly, melt blown nonwovens are also manufactured by directly extruding thermoplastic polymers, especially high melt flow polypropylene. Their applications include filtration, feminine hygiene, wipers, face masks and absorbents.

Selected antimicrobial substances can be incorporated into the polymer melt before the extrusion. This method enables the antimicrobials to be built into the nonwovens and to migrate onto the surface. Long lasting antimicrobial efficacy of such type of materials is achieved by the continues migration of the active ingredient to the surface. The disadvantage of such type of incorporation is that the processing temperature for manufacturing melt blown and spunbond nonwovens is usually very high, i.e., up to 300° C. At such temperature, the involved antimicrobials, especially organic based antimicrobials can cause problems in volatility as well as thermostability.

It is therefore desirable to find an alternative process in which antimicrobials, preferably organic based antimicrobials, are incorporated in nonwoven materials, preferably those made by spunbond and melt blown processes, without undergoing a high temperature process.

Surprisingly, it was found that this object can be achieved in treating an already-formed nonwoven with a formulation comprising (a) an antimicrobial agent selected from
- ($a_1$) halogeno-o-hydroxydiphenyl compound;
- ($a_2$) phenol derivative;
- ($a_3$) benzyl compound;
- ($a_4$) chlorohexidine and a derivative thereof;
- ($a_5$) $C_{12}$–$C_{14}$alkylbetaine and C8–$C_{18}$fatty acid amidoalkylbetaine;
- ($a_6$) an amphoteric surfactant;
- ($a_7$) trihalocarbanilide;
- ($a_8$) quaternary and polyquaternary compound; and
- ($a_9$) a thiazole compound; and
- ($a_{10}$) a iodine containing agent;
- ($a_{11}$) a naphthyl derivative;

(b) a solubilizing agent; and optionally (c) at least one copolymer made from two or more monomers, with at least one monomer having good affinity to the textiles and at least another monomer having affinity to the involved antimicrobial substances.

The nonwovens used for the process of the present invention are preferably prepared by spun bond and melt blown processes or by carded chemical bonding, carded thermal bonding, dry and/or wet laid and needlefelts.

Preferably, the antimicrobial agent ($a_1$) is selected from compounds of the formula (1)

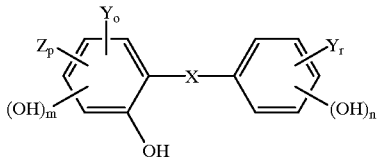

wherein

X is oxygen, sulfur or —$CH_2$—,

Y is chloro or bromo,

Z is $SO_2H$, $NO_2$ or $C_1$–$C_4$-Alkyl, r is 0 to 3, o is 0 to 3, p is 0 or 1, m is 0 or 1 and n is 0 or 1;

and at least one of r or o is ≠0.

Preferably, in the present process, antimicrobial agents ($a_1$) of formula (1) are used, wherein X is oxygen, sulfur or —$CH_2$—, and Y is chloro or bromo, m is 0, n is 0 or 1, o is 1 or 2, r is 1 to 3 and p is 0.

Of particular interest as antimicrobial agent ($a_1$) is a compound of formula (2)

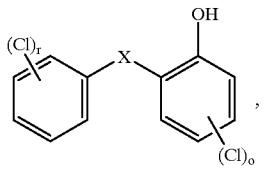

wherein

X is —O— or —$CH_2$—;

r is 1 to 3; and o is 1 or 2, and most preferably a compound of formula (3a)

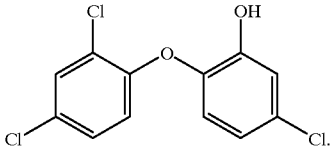

or (3b)

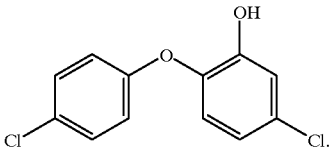

Preferred phenol derivatives ($a_2$) correspond to formula (4)

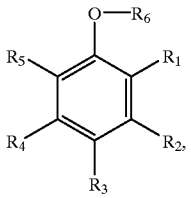

wherein $R_1$ is hydrogen, hydroxy, $C_1$–$C_4$alkyl, chloro, nitro, phenyl or benzyl, $R_2$ is hydrogen, hydroxy, $C_1$–$C_6$alkyl or halogen, $R_3$ is hydrogen, $C_1$–$C_6$alkyl, hydroxy, chloro, nitro or a sulfo group in the form of the alkali metal salts or ammonium salts thereof, $R_4$ is hydrogen or methyl, $R_5$ is hydrogen or nitro; and $R_6$ is hydrogen; or a radical of formula (4a)

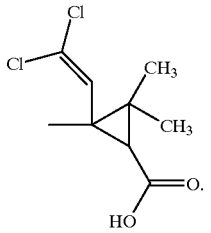

Such compounds are typically chlorophenols (o-, m-, p-chlorophenols), 2,4-dichlorophenol, p-nitrophenol, picric acid, xylenol, p-chloro-m-xylenol, cresols (o-, m-, p-cresols), p-chloro-m-cresol, pyrocatechin, resorcinol, orcinol, 4-n-hexylresorcinol, pyrogallol, phloroglucine, carvacrol, thymol, p-chlorothymol, o-phenylphenol, o-benzylphenol, p-chloro-o-benzylphenol and 4-phenolsulfonic acid.

Typical antimicrobial agents ($a_3$) correspond to the formula (5)

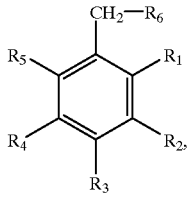

wherein $R_1$, $R_2$, $R_3$, $R_4$, $R_5$ are each independently of one another hydrogen or chloro; and $R_6$ is —OH; or —O—(CO)—$C_6H_5$.

Illustrative examples of compounds of formula (5) are benzyl alcohol, 2,4-, 3,5- or 2,6-dichlorobenzyl alcohol and trichlorobenzyl alcohol.

Antimicrobial agent ($a_4$) is chlorhexidine and salts thereof, for example 1,1'-hexamethylene-bis-(5-(p-chlorophenyl)-biguanide), together with organic and inorganic acids and chlorhexidine derivatives such as their diacetate, digluconate or dihydrochloride compounds.

Antimicrobial agent ($a_5$) is typically $C_8$–$C_8$cocamidopropylbetaine.

Amphoteric surfactants as antimicrobial agents ($a_6$) are suitably $C_{12}$alkylaminocarboxylic and $C_1$–$C_3$alkanecarboxylic acids such as alkylaminoacetates or alkylaminopropionates.

Typical trihalocarbanilides which are useful as antimicrobial agent ($a_7$) are compounds of the formula (6)

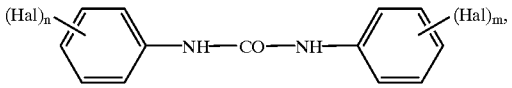

wherein

Hal is chloro or bromo, n and m are 1 or 2, and n+m are 3.

The quaternary and polyquaternary compounds which correspond to antimicrobial agent ($a_8$) are of the formula (7)

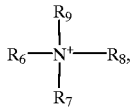

wherein $R_6$, $R_7$, $R_8$ and $R_9$ are each independently of one another $C_1$–$C_{18}$alkyl, $C_1$–$C_{18}$alkoxy or phenyl-lower alkyl, and Hal is chloro or bromo.

Among these salts, the compound of formula (8)

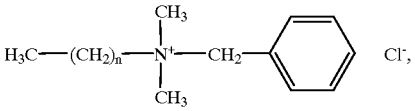

wherein n is an integer from 7 to 17, is very particularly preferred.

A further exemplified compound is cetyl trimethylethyl ammonium bromide.

Of particular interest as antimicrobial agent ($a_9$) is methylchloroisothiazoline.

Iodine containing agents ($a_{10}$) are for example iodopropyl butyl carbamate.

Preffered antimicrobial agent ($a_{11}$) is the compound of formula (9)

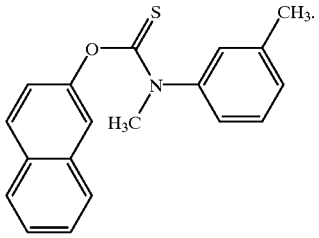

The antimicrobial agents which are used in the present process are water-soluble or only sparingly soluble in water. In the present aqueous formulation they may therefore be applied in solubilized, emulsified or dispersed form.

The present aqueous formulation therefore additionally comprises a small amount of an organic solvent, a surfactant, a dispersant, and/or an emulsifier as component (b). This component is useful for solubilization and stabilization of the antimicrobial agents in the present aqueous formulation.

Suitable solubilizing agents are anionic, nonionic or zwitterionic and amphoteric synthetic, surface-active substances.

Suitable anionic surface-active substances are:

sulfates, typically fatty alcohol sulfates, which contain 8 to 18 carbon atoms in the alkyl chain, e.g. sulfated lauryl alcohol;

fatty alcohol ether sulfates, typically the acid esters or the salts thereof of a polyadduct of 2 to 30 mol of ethylene oxide with 1 mol of a $C_8$–$C_{22}$fatty alcohol;

the alkali metal salts, ammonium salts or amine salts of $C_8$–$C_{20}$fatty acids, which are termed soaps, typically coconut fatty acid;

alkylamide sulfates;

alkylamine sulfates, typically monoethanolamine lauryl sulfate;

alkylamide ether sulfates;

alkylaryl polyether sulfates;

monoglyceride sulfates;

alkane sulfonates, containing 8 to 20 carbon atoms in the alkyl chain, e.g. dodecyl sulfonate;

alkylamide sulfonates;

alkylaryl sulfonates;

a-olefin sulfonates;

sulfosuccinic acid derivatives, typically alkyl sulfosuccinates, alkyl ether sulfosuccinates or alkyl sulfosuccinamide derivatives;

N-[alkylamidoalkyl]amino acids of formula (10)

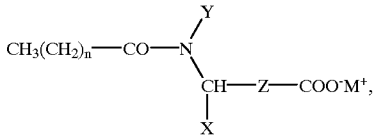

wherein

X is hydrogen, $C_1$–$C_4$alkyl or —$COO^-M^+$,

Y is hydrogen or $C_1$–$C_4$alkyl,

Z is: —$(CH_2)_{m_1-1}$—

$m_1$ is 1 to 5, $n_1$ is an integer from 6 to 18, and

M is an alkali metal ion or an amine ion;

alkyl ether carboxylates and alkylaryl ether carboxylates of formula (11) $CH_3$—X—Y—A, wherein X is a radical: —$(CH_2)_{5-19}$—O—

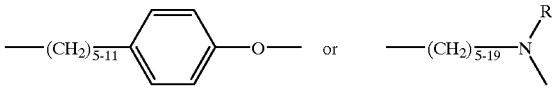

R is hydrogen or $C_1$–$C_4$alkyl,

Y is: —$(CHCHO)_{1-50}$—

A is: —$(CH_2)_{m_2-1}$—$COO^-M^+$ or:

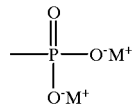

$m_2$ is 1 to 6, and

M is an alkali metal cation or an amine cation.

The anionic surfactants used may furthermore be fatty acid methyl taurides, alkylisothionates, fatty acid polypeptide condensates and fatty alcohol phosphoric acid esters. The alkyl radicals in these compounds preferably contain 8 to 24 carbon atoms.

The anionic surfactants are usually obtained in the form of their water-soluble salts, such as the alkali metal, ammonium or amine salts. Typical examples of such salts are lithium, sodium, potassium, ammonium, triethylamine, ethanolamine, diethanolamine or triethanolamine salts. It is preferred to use the sodium or potassium salts or the ammonium-($NR_1R_2R_3$) salts, wherein $R_1$, $R_2$ and $R_3$ are each independently of one another hydrogen, $C_1$–$C_4$alkyl or $C_1$–$C_4$hydroxyalkyl.

Very particularly preferred anionic surfactants used for the present process are monoethanolamine lauryl sulfate or the alkali metal salts of fatty alcohol sulfates, preferably the sodium lauryl sulfate or sodium laureth-2 sulfate.

Suitable zwitterionic and amphoteric surfactants are imidazoline carboxylates, alkylamphocarboxy carboxylic acids, alkylamphocarboxylic acids (e.g. lauroamphoglycinate) and N-alkyl-b-aminopropionates or N-alkyl-b-iminodipropionates.

Nonionic surfactants are typically derivatives of the adducts of propylene oxide/ethylene oxide having a molecular weight of 1000 to 15000, fatty alcohol ethoxylates (1–50 EO), alkylphenol polyglycol ethers (1–50 EO), ethoxylated carbohydrates, fatty acid glycol partial esters, typically diethylene glycol monostearate, PEG 5 glyceryl stearate; PEG 15 glyceryl stearate; PEG 25 glyceryl stearate; cetearyl octanoate; fatty acid alkanolamides and fatty acid dialkanolamides, fatty acid alkanolamide ethoxylates and fatty acid amine oxides.

Furthermore, the salts of saturated and unsaturated $C_8$–$C_{22}$fatty acids may be used as solubilizing agents, either by themselves, in admixture with each other or in admixture with the other surface-active substances cited for component (b). Illustrative examples of these fatty acids are typically capric, lauric, myristic, palmitic, stearic, arachic, behenic, dodecenoic, tetradecenoic, octadecenoic, oleic, eicosanic and erucic acid, as well as the technical mixtures of such acids, typically coconut fatty acid. These acids may be obtained in the form of salts, suitable cations being alkali metal cations such as sodium and potassium cations, metal atoms such as zinc atoms and aluminium atoms or nitrogen-containing organic compounds of sufficient alkalinity, typically amines or ethoxylated amines. These salts can also be prepared in situ.

Furthermore, suitable solubilizing agents are dihydric alcohols, preferably those containing 2 to 6 carbon atoms in the alkylene radical, typically ethylene glycol, 1,2- or 1,3-propanediol, 1,3-, 1,4- or 2,3-butanediol, 1,5-pentanediol and 1,6-hexanediol or monohydric alcohol like methanol; ethanol or propanol; and acetone.

If the antimicrobial agents according to component (a) are applied in dispersed form they are milled with an appropriate dispersant, conveniently using quartz balls and an impeller, to a particle size of 1–2 mm.

Suitable dispersants for the antimicrobial agents in the present process are:

acid esters or their salts of alkylene oxide adducts, typically acid esters or their salts of a polyadduct of 4 to 40 mol of ethylene oxide with 1 mol of a phenol, or phosphated polyadducts of 6 to 30 mol of ethylene oxide with 1 mol of 4-nonylphenol, 1 mol of dinonylphenol or, preferably, with 1 mol of compounds which are prepared by addition of 1 to 3 mol of unsubstituted or substituted styrenes to 1 mol of phenol, polystyrene sulfonates, fatty acid taurides, alkylated diphenyl oxide mono- or disulfonates, sulfonates of polycarboxylates, the polyadducts of 1 to 60 mol of ethylene oxide and/or propylene oxide with fatty amines, fatty acids or fatty alcohols, each containing 8 to 22 carbon atoms in the alkyl chain, with alkylphenols containing 4 to 16 carbon atoms in the alkyl chain, or with trihydric to hexahydric alkanols containing 3 to 6 carbon atoms, which polyadducts are converted into an acid ester with an organic dicarboxylic acid or with an inorganic polybasic acid, ligninsulfonates, and, most preferably, formaldehyde condensates such as condensates of ligninsulfonates and/or phenol and formaldehyde, condensates of formaldehyde with aromatic sulfonic acids, typically condensates of ditolyl ether sulfonates and formaldehyde, condensates of naphthalenesulfonic acid and/or naphthol- or naphthylaminesulfonic acids with formaldehyde, condensates of phenolsulfonic acids and/or sulfonated dihydroxydiphenylsulfone and phenols or cresols with formaldehyde and/or urea, as well as condensates of diphenyl oxide-disulfonic acid derivatives with formaldehyde.

In the dispersion the concentration of the antimicrobial agent is from 0.001 to 50%, preferably from 2–20% b.w.

The aqueous formulation which is used for the present process may further comprise as component (c) at least one copolymer.

The copolymer (c) preferably is a silicone-ethylene oxide copolymer, a silicone-ethylene oxide-propylene oxide copolymer, a vinyl acetate ethylene copolymer, a copolymer of polyvinyl methyl ether-maleic anhydride or a copolymer which is obtained from a hydrophilic silicone.

Ideally this component helps to bind the antimicrobial agents to the nonwoven substrates and simultaneously acts as a surface finishing agent to improve either the hydrophilic or hydrophobic property of the said nonwoven depending on the desired applications.

If the nonwoven is made by another process than a spun bond or melt blown process, i.e. a carded thermal bonding, carded chemical bonding, dry and/or wet laid and needlefelts such a copolymer alternatively may act as a binder which after subsequent curing process is essential for the formation of the web for the said nonwoven.

A key feature in the selection of the copolymer (c) is that it should have good affinity to the nonwoven substrate as well as to the involved antimicrobial agent(s).

The aqueous formulation of the present invention preferably comprises 0.001 to 50, preferably 2 to 20% b.w. of an antimicrobial agent (a), 1 to 50, preferably 5 to 30% b.w. of a solubilizing agent or dispersant (b); 0 to 50, preferably 1 to 10% b.w. of at least one copolymer (c).

The aqueous formulation of the present invention can be prepared by first optionally mixing the solubilized or dispersed antimicrobial agent with the copolymer (c) and than adding the desired amount of water to obtain the aqueous formulation.

The present aqueous formulation can be in the form of solution, dispersion and/or emulsion which can be sprayed onto the surface of textiles. It is also possible to use other processes such as passing said fiber in a dyeing-like process through an aqueous liquor that contains the present formulation or immersing said fiber into an aqueous liquor.

Preferably, the formulation is water based and free of any organic solvents. The advantage of this feature is that during the subsequent drying process, environmental and toxicological problems involving organic solvents will not arise.

The aqueous formulation may also be prepared in concentrated form, which preferably comprises 5 to 50% b.w. of an antimicrobial agent (a), 10 to 50% b.w. of a solubilizing agent or dispersant (b), and 0 to 50, preferably 10 to 50% b.w. of at least one copolymer (c).

This concentrated liquid formulation can be diluted with water and used for further treatment.

The nonwoven fiber materials which can be treated with the formulation of the present invention are made of polypropylene, polyester, polyethylene and polyamide by spunbonding and/or melt blowing where the processing temperatures (for fiber extrusion) are usually very high, i.e. up to 300° C. It is also possible that the nonwovens are made of fiber blends such as those above mentioned and other fibers such as viscose, cellulose acetate, polyacrylonitrile, and neutral fibers.

The process of the present invention provides a method of antimicrobial finishing non-woven materials without the need of undergoing thermal process in which high temperatures are involved. Such a process is advantageous for antimicrobials with certain volatility. Additional advantage of such a process is that it can be combined with other treatment such as binding and hydrophilic or hydrophobic finishing. Therefore nonwovens with multi-functions can be obtained with minimal processing costs.

The process of this invention makes it possible to obtain antimicrobial finished nonwovens having long lasting efficacy. The nonwovens finished by the process of the present invention are advantageous with respect to inhibition of microorganisms, reduction of the risk of contamination, reduction of odor, increase in freshness and improvement in hygienic conditions.

Furthermore, the nonwoven textiles which are treated with the process of the present invention exhibit the desired hydrophilicity or hydrophobicity. Particularly, an improved hydrophilicity is often desirable for a wide range of applications such as in personal care products.

Nonwoven materials which are finished with the process of the present invention are particularly suitable for making disposable hygienic products, such as wipers, diapers, adult incontinence or feminine hygiene products.

In the following Examples, percentages are by weight. The amounts of dye and antimicrobial agent are based on pure substance.

EXAMPLE 1

The antimicrobial agent compound of formula (101)

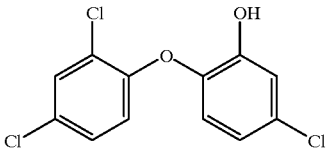

(Triclosan)

is dissolved in a small amount of ethanol followed by addition of silicone-ethylene oxide-propylene oxide copolymer (MW4100 from Dow Corning) as finishing agent. To this mixture, 95 ml of water is added. The resulting formulation is an emulsion that can be used for the treatment of the nonwoven materials.

| | | |
|---|---|---|
| Formulation 1: | silicone-ethylene oxide-propylene oxide copolymer, for example Dow Corning 4100 | 5 g |
| | ethanol | 5 ml |
| | water | 95 ml |
| | Triclosan | 30 mg |

EXAMPLE 2

Preparation procedure is as described in Example 1 but the formulation of the emulsion is as follows:

| | | |
|---|---|---|
| Formulation 2: | silicone-ethylene oxide-propylene oxide copolymer, for example Dow Corning 4100 | 1 g |
| | Glycerin | 2 ml |
| | PEG-40 Hydrogenated Castor Oil, for example Eumulgin HRE-40/Henkel | 2 ml |
| | Water | 95 ml |
| | Triclosan | 30 mg |

EXAMPLE 3

Preparation procedure is as described in Example 1 but the formulation of the emulsion is as follows:

| | | |
|---|---|---|
| Formulation 3: | silicone-ethylene oxide-propylene oxide copolymer, for example Dow Corning 4100 | 1.25 g |
| | sodium lauryl sulphonate | 500 mg |
| | Triclosan | 100 mg |
| | Adding water to 100 ml | |

EXAMPLE 4

Preparation procedure is as described in Example 1 but the formulation of the emulsion is as follows:

| | | |
|---|---|---|
| Formulation 4: | silicone-ethylene oxide-propylene oxide copolymer, for example Dow Corning 4100 | 1.25 g |
| | Dehydol 04 | 500 mg |
| | Triclosan | 100 mg |
| | Adding water to 100 ml | |

EXAMPLE 5

10 g of polypropylene nonwoven material is immersed into 100 ml of the emulsion as prepared in example 1. After five minutes the nonwoven material is withdrawn from the emulsion and is laid on an aluminium foil in a fume cupboard for drying at room temperature. The dried nonwoven material can be used for further testing for antimicrobial properties.

EXAMPLE 6

100 ml of the emulsion as prepared according to Example 1 is sprayed onto the surface of approximately 10 g of a polypropylene nonwoven material. After the spraying, the nonwoven material is allowed to dry at room temperature overnight. The treated nonwoven material can be used for further testing.

EXAMPLE 7

100 ml of the emulsion as prepared according to Example 2 is applied to the surface of approximately 10 g of a polypropylene nonwoven as a spray. The treated textile is subjected to drying in an oven set at 60° C. The dried textile can be used for further testing.

EXAMPLE 8

12 g of Nonwoven material (from Corovin, Germany) is treated with the formulation 3 (Example 3) by immersing the nonwoven material in the formulation. The treated material is dried at 40° C. and can then be used for further tests.

EXAMPLE 9

12 g of Nonwoven material (from Corovin, Germany) is treated with the formulation 4 (Example 4) by immersing the nonwoven material in the formulation. The treated material is dried at 40° C. and can then be used for further tests.

EXAMPLE 10

To demonstrate the antimicrobial activity an agar diffusion test according to the method CG 147 against gram-positive and gram-negative strains was carried out.

Tested Samples

Sample 1: Corovin NIV

Sample 2: Fibreweb NW

Sample 3: Libeltex

Sample 4: Placebo (NIV)

The polypropylene nonwoven samples are treated as described in Example 5.

Test Bacteria

*Staphylococcus aureaus*

*Escherichia coli*

*Proteus vulgaris*

Nutrient Medium

Casein soya meal pepton agar

Incubation at 37° C. for 24 hours (28° C. for *Proteus vulgaris*)

Test Principle

For the preparation of the agar plates a bottom layer of 15 ml sterile agar medium is poured into petri dishes and after solidification of the agar, 6 ml of a germ-containing agar are evenly distributed on the bottom agar layer.

In order to prepare the germ-containing agar 3,5 ml of an 1:100 (*Staph. aureus*) and 1:1000 (*E. coli* and *Pr. Vulgaris*) diluted over-night cultures of the bacteria are mixed with 500 ml molten agar at 47° C.

After solidification of the top layer, the samples (discs with 20 mm diameter) are applied in the middle of the inoculated plates (one sample on each agar plate). Each sample is tested twice.

All plates are then incubated. After incubation the zones of inhibition are measured, the growth under the discs evaluated and listed in the following Table 1:

TABLE 1

| | *Staphylococcus aureaus* | | *Escherichia coli* | | *Proteus vulgaris* | |
|---|---|---|---|---|---|---|
| | ZI | VR | ZI | VR | ZI | VR |
| Corovin NIV | 15/15 | 4/4 | 10/10 | 4/4 | 5/5 | 4/4 |
| Fibreweb NW | 14/15 | 4/4 | 10/11 | 4/4 | 4/4 | 4/4 |
| Libeltex | 14/15 | 4/4 | 10/10 | 4/4 | 4/4 | 4/4 |
| Placebo (NIV) | 0/0 | 0/0 | 0/0 | 0/0 | 0/0 | 0/0 |

The results in the Table above show that the polypropylene nonwoven samples tested according to the agar diffusion method show excellent antibacterial effects against the gram positive *Staphylococcus aureus* and the gram negatives *Escherichia coli* and *Proteus vulgaris*.

EXAMPLE 11

A formulation comprising 20 g of the compound of formula (101) 30 g of PEG nonylphenyl ether; and water to 100 ml is prepared.

EXAMPLE 12

An aqueous bath comprising 1.5 g of the formulation as prepared in Example 11 and 20 g of a poly(vinyl acetate ethylene) binder is prepared.

EXAMPLE 13

10 g of a nonwoven material (PES viscose, 50:50) is impregnated into the aqueous bath as prepared in Example 12. Approximately 10 g of the aqueous bath is absorbed in the nonwoven material. After the impregnation the nonwoven material is dried in an oven at 80° C. for 2 hours. The treated nonwoven material contains 0.3% b.w. of Triclosan. After drying the nonwoven is ready for further assessment.

EXAMPLE 14

The antimicrobial efficacy of the treated nonwoven as prepared in Example 13 is tested in an agar diffusion test:

Tested Samples

Sample 1: Nonwoven (PES/viscose, 50:50) with 0.3% b.w of Triclosan

Sample 2: Nonwoven (PES/viscose, 50:50) untreated

Test Bacteria

*Staphylococcus aureus* ATCC 9144

*Escherichia coli* NCTC 8196

*Proteus vulgaris* ATCC 13315

Nutrient Medium

Casein soya meal pepton agar

Incubation at 37° C. for 24 hours (28° C. for *Proteus vulgaris*)

Test Principle

For the preparation of the agar plates a bottom layer of 15 ml sterile agar medium is poured into petri dishes and after solidification of the agar, 6 ml of a germ-containing agar are evenly distributed on the bottom agar layer.

In order to prepare the germ-containing agar 3,5 ml of an 1:100 (*Staph. aureus*) and 1:1000 (*E. coli* and *Pr. vulgaris*) diluted over-night cultures of the bacteria are mixed with 500 ml molten agar at 47° C.

After solidification of the top layer, the samples (discs with 20 mm diameter) are applied in the middle of the inoculated plates (one sample on each agar plate). Each sample is tested twice.

All plates are then incubated. After incubation the zones of inhibition are measured, the growth under the discs evaluated and listed in the following Table 2:

TABLE 2

| | *Staphylococcus aureaus* | | *Escherichia coli* | | *Proteus vulgaris* | |
|---|---|---|---|---|---|---|
| | ZI | VR | ZI | VR | ZI | VR |
| Placebo | | | | | | |
| Untreated PES/viscose nonwoven | 0/0 | 0/0 | 0/0 | 0/0 | 0/0 | 0/0 |
| PES/viscose nonwoven, treated with 0.3% b.w. Triclosan | 12/12 | 4/4 | 9/9 | 4/4 | 5/5 | 4/4 |

What is claimed is:

1. A process for the incorporation of an antimicrobial agent into a non-woven comprising treating the nonwoven with an aqueous comprising (a) an antimicrobial halogeno-o-hydroxydiphenyl agent ($a_1$), (b) a solubilizing agent for the antimicrobial agent; and optionally (c) at least one copolymer made from two or more monomers, with at least one monomer having good affinity to the textiles and at least another monomer having affinity to the involved antimicrobial substances.

2. A process according to claim 1 wherein the nonwovens are prepared by spun bond and melt blown processes.

3. A process according to claim 1 wherein the nonwovens are prepared by carded thermal bonding, carded chemical bonding, dry and/or wet laid and needlefelts.

4. A process according to claim 1 wherein the antimicrobial agent ($a_1$) is a compound of formula (1)

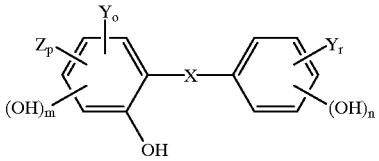

wherein

X is oxygen, sulfur or —$CH_2$—,

Y is chloro or bromo,

Z is $SO_2H$, $NO_2$ or $C_1$–$C_4$-Alkyl, r is 0 to 3, o is 0 to 3, p is 0 or 1, m is 0 or 1 and n is 0 or 1;

and at least one of r or o is ≠0.

5. A process according to claim 4, wherein the antimicrobial agent ($a_1$) is a compound of formula (1), wherein X is oxygen, sulfur or —$CH_2$—, and Y is chloro or bromo, m is 0, n is 0 or 1, o is 1 or 2, r is 1 to 3 and p is 0.

6. A process according to claim 4, wherein the antimicrobial agent ($a_1$) is a compound of formula (2)

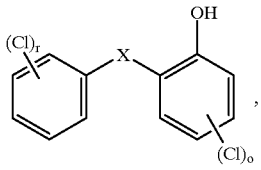

wherein

X is —O— or —$CH_2$—;

r is 1 to 3; and o is 1 or 2.

7. A process according to claim 6 wherein the antimicrobial agent ($a_1$) is a compound of formula (3a)

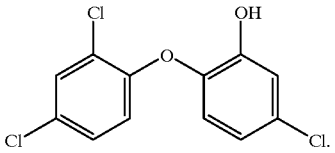

8. A process according to claim 6 wherein the antimicrobial agent ($a_1$) is a compound of formula (3b)

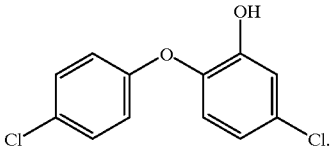

9. A process according to claim 1 wherein the solubilizing agent (b) is selected from a surfactant, a dispersant, an emulsifier and an organic solvent.

10. A process according to claim 1 wherein the copolymer (c) is silicone-ethylene oxide copolymer.

11. A process according to claim 1 wherein the copolymer (c) is silicone-ethylene oxide-propylene oxide copolymer.

12. A process according to claim 1 wherein the copolymer (c) is vinyl acetate ethylene copolymer.

13. A process according to claim 1 wherein the copolymer (c) is obtained by a hydrophilic silicone.

14. A process according to claim 1 wherein the copolymer (c) is a polyvinyl methyl ether-maleic anhydride.

15. A process according to claim 2 wherein the copolymer (c) is used as an agent for the improvement of the hydrophilic or hydrophobic properties of the nonwovens involved.

16. A process according to claim 3 wherein the copolymer (c) is used as a binder.

17. A process according to claim 1 wherein the formulation of the present invention comprises 0.1 to 30% by weight of an antimicrobial agent (a), 10 to 50% by weight of a solubilizing or dispersing agent (b), and 0 to 50% by weight of at least one copolymer (c).

18. A process according to claim 1 wherein the nonwoven material is incorporated by immersing, passing through or spraying.

19. A process for the preparation of a formulation according to claim 1 which comprises first optionally mixing the solubilized or dispersed antimicrobial agent with the copolymer (c) and then adding the desired amount of water to obtain the aqueous formulation.

* * * * *